US008842019B2

(12) United States Patent
Boccola

(10) Patent No.: US 8,842,019 B2
(45) Date of Patent: Sep. 23, 2014

(54) SYSTEM FOR MONITORING THE UTILIZATION OF PERSONAL PROTECTIVE EQUIPMENT BY WORKERS IN THE WORKPLACE

(75) Inventor: Enrico Boccola, Naples (IT)

(73) Assignee: Selex Sistemi Integrati S.p.A., Roma (IT)

( * ) Notice: Subject to any disclaimer, the term of this patent is extended or adjusted under 35 U.S.C. 154(b) by 391 days.

(21) Appl. No.: 13/113,012

(22) Filed: May 20, 2011

(65) Prior Publication Data

US 2012/0001765 A1 Jan. 5, 2012

(30) Foreign Application Priority Data

May 21, 2010 (IT) ..... TO2010A0426

(51) Int. Cl.
*G08B 21/00* (2006.01)
*G08B 21/24* (2006.01)

(52) U.S. Cl.
CPC ..... *G08B 21/24* (2013.01)
USPC ..... 340/686.1

(58) Field of Classification Search
None
See application file for complete search history.

(56) References Cited

U.S. PATENT DOCUMENTS 8,207,858 B2 * 6/2012 Knopf et al. ..... 340/573.1
8,232,888 B2 * 7/2012 Frederick et al. ..... 340/686.1
8,294,580 B2 * 10/2012 Witwer et al. ..... 340/572.1
2003/0098792 A1 * 5/2003 Edwards et al. ..... 340/573.1
2004/0100384 A1 * 5/2004 Chen et al. ..... 340/572.1
2008/0018472 A1 * 1/2008 Dasilva et al. ..... 340/572.4
2008/0256687 A1 * 10/2008 Spencer ..... 2/425
2008/0316031 A1 * 12/2008 Kalama et al. ..... 340/572.1
2010/0045464 A1 * 2/2010 Knopf et al. ..... 340/573.1
2010/0188187 A1 * 7/2010 Mughal et al. ..... 337/225
2010/0289662 A1 * 11/2010 Dasilva et al. ..... 340/686.6
2010/0295660 A1 * 11/2010 Farioli Brioschi et al. .. 340/10.1
2011/0115629 A1 * 5/2011 Holler et al. ..... 340/572.1

FOREIGN PATENT DOCUMENTS

WO WO 2009032417 A1 * 3/2009 ..... G06Q 10/00

OTHER PUBLICATIONS

Italian Search Report in Italian Application TO2010A 000426, dated Jan. 4, 2011.

* cited by examiner

*Primary Examiner* — Hai Phan
*Assistant Examiner* — Zhen Y Wu
(74) *Attorney, Agent, or Firm* — Marshall, Gerstein, Borun LLP

(57) ABSTRACT

A system for monitoring the utilization of personal protective equipment by workers in the workplace can include a set of first slave electronic modules, each paired to a corresponding piece of personal protective equipment. A master electronic module paired to a corresponding worker may form a network with the personal protective equipment that the corresponding worker is equipped with. The master electronic module may acquire and store information from the first slave electronic modules. A set of monitoring devices arranged in a corresponding work area in the workplace may acquire information from the master electronic modules present within the work area. A central control and monitoring unit may acquire information from the monitoring devices.

16 Claims, 2 Drawing Sheets

SYSTEM FOR MONITORING THE UTILIZATION OF PERSONAL PROTECTIVE EQUIPMENT BY WORKERS IN THE WORKPLACE

TECHNICAL FIELD OF INVENTION

The present invention relates to a system for monitoring the utilization of personal protective equipment (PPE) by workers in the workplace. In particular, the present invention can be advantageously, but not exclusively, used to avoid accidents in the workplace and to support tutoring of workers with regard to safety in the workplace.

STATE OF THE ART

As is known, the problem of accidents has always beset the world of work. Unfortunately, the size of this problem is very significant. For example, it emerges from industrial accident statistics that there are approximately three deaths due to industrial accidents every day in Italy, where they are known as "white deaths". Furthermore, in addition to fatal accidents, countless more or less serious accidents are also regrettably recorded every day. Among other things, beyond the human aspects of the problem, the so-called social costs of the problem must also be taken into account.

A brief analysis of industrial accident statistics, intended to point out the main causes of accidents in Italy, is provided below.

With reference to the number of accidents reported by companies according to sector of economic activity, it emerges that the sector with the largest incidence of accidents is that of manufacturing (which in any case occupies the largest number of people) with over 40% of reported cases. The construction sector takes second place with approximately 20% that, referring only to cases of death, rises to approximately 26%. The causes or the ways in which the reported accidents take place reveal that the largest number of accidents is due to colliding with objects, which represents approximately 23% of the total, while falling from a height represents approximately 8% of the total. Instead, if reference is made only to cases of death, driving accidents take first place with approximately 46%, while falling from a height is in second place with 16%.

Analysis of the data provided by statistics on industrial accident in Italy clearly exposes the high level of risk peculiar to the construction sector. In fact, this sector, although only occupying 8% of the workforce, causes 20% of the accidents reported and 26% of the deaths in work accidents. In any case, the problem of accidents in the workplace, unfortunately, generally afflicts every sector of economic activity.

On the basis of what has been described so far, it is easily understandable how, in recent years, the need has become increasingly felt to ensure the safety of workers in the workplace.

In particular, in the past, it was attempted to find a solution to the problem of accidents in the workplace only on a regulatory basis. For example, in Italy, the problem of safety in the world of work has been dealt with at regulatory level through a complex system of laws and associated enforcement regulations, starting from Italian Law No. 626 of 1994 up to the consolidation act on matters concerning health and safety in the workplace contained in Italian Legislative Decree No. 81 of 2008. In particular, among other things, these last regulations attempt to stimulate the use of new technologies emerging in the so-called "Information Communication Technology" (ICT) field in order to try to improve work conditions and to find a solution to the problem of safety at work.

Naturally, attempts to make use of modern technologies, especially in ICT, for safety at work have been made in many other countries as well as in Italy. In consequence, in recent years, many projects have been worked on all around the world aimed at developing automatic and intelligent systems directed to ensuring the safety of workers in the workplace.

In particular, in the last few years, projects have been developed that are oriented to introducing a radically new concept in the safety at work sector, that of "active safety", the application of which has the objective of drastically reducing the number of industrial accidents.

"Active safety" is a term normally used in the automotive sector. In this sector, "active safety" is intended as the set of devices, systems or apparatuses that are aimed at preventing an accident from occurring and thus have a primarily preventive function and/or at limiting the causes or the damage caused by accidents, such as, for example, anti-skid braking systems ("Antilock Braking System" or "Antiblockiersystem"—ABS), electronic stability control systems ("Elektronisches StabilitätsProgramm"—ESP), anti-collision radar systems and, in a possible future scenario, driverless vehicles with autopilot systems.

In the safety at work sector, without resorting to possible future scenarios, ICT technologies are already available today that can help ensure safety in the workplace, such as the Radio Frequency Identification (RFID) technology for example.

In particular, RFID technology enables the detection and identification of equipment, persons or things within the scope of a given operating scenario.

An example of a system for ensuring the safety of workers based on RFID technology is provided in United States Patent Application US 2004/0100384 A1.

In particular, this patent application describes a method and system that are based on RFID technology and are able to ensure that workers are adequately equipped with the necessary equipment for carrying out a specific task or activity.

In detail, as described in United States Patent Application 2004/0100384 A1, each piece of equipment required to carry out a specific activity is paired to a corresponding RFID tag that contains information to identify said device. In addition, an RFID scanner is disposed at a given location through which a worker must pass prior to carrying out said specific activity. When a worker passes through the given location, the RFID scanner interrogates the RFID tag and determines whether the worker is carrying all the necessary pieces of equipment. If the worker does not have all of the necessary equipment, the RFID scanner can, for example, generate audible and/or visual alarms or even display the missing piece(s) of equipment on a screen.

Furthermore, according to US 2004/0100384, the RFID scanner could be connected to an automatic door and command its opening only the case where the worker has all the necessary equipment. The given location could be the entrance to a first specific area where the worker must perform a specific activity. For example, the worker could be a doctor or a nurse and the first specific area could be an operating room. Alternatively, the given location could be the exit of a second specific area that the worker must leave to be able to carry out the specific activity. For example, the worker could be a firefighter and the second specific area could be the locker room where the firefighters change and equip themselves before leaving to respond to a call.

On the other hand, again according to US 2004/0100384, the RFID tags could include further information, such as, for example, information regarding the maintenance operations already carried out or to be carried out on the respective pieces of equipment, expiry dates, etc. Furthermore, the RFID tags could also comprise pointers or links to further information on the respective pieces of equipment contained in a database connected to the RFID scanner, or even URL addresses of a web site, again containing information on the respective pieces of equipment.

Lastly, always according to US 2004/0100384, even certain workers could be paired to corresponding RFID tags containing information to identify said workers. Furthermore, a database connected to the RFID scanner could store special equipment requirements or profiles corresponding to the various identified workers.

However, the Applicant has noted that the system described in US 2004/0100384 is not completely reliable because it is not really able to detect if a worker is effectively equipped with all of the equipment required for performing the specific activity.

In fact, it could be assumed, for example, that:

- the equipment required for the specific activity consists of a given set U of pieces of equipment, definable, according to set theory, as a universal set;
- a first worker is equipped with the respective pieces of equipment belonging to a first subset A of the given set U; and
- a second worker is equipped with the respective pieces of equipment belonging to a second subset B of the given set U, said second subset B being the relative complement of the first subset A with respect to the universal set U.

Given the previous assumptions, if the first and the second worker arrive together in proximity to the RFID scanner, said RFID scanner would detect the present of all the pieces of equipment required for the specific activity and therefore allow both workers to pass without any problem, even though neither of them would, in reality, be adequately equipped to perform the specific activity.

The above problem also arises in the case where each worker is paired to a respective RFID identification tag.

In fact, it could be assumed, for example, that:

- a third worker paired to a respective RFID identification tag is equipped with two of all pieces of equipment required for the specific activity, while
- a fourth worker paired to a respective RFID identification tag does not have any of the equipment required for the specific activity.

Given the previous assumptions, if the third and the fourth worker arrive together in proximity to the RFID scanner, said RFID scanner would detect the presence of the two workers and, at the same time, the presence of two complete sets of equipment for the specific activity and therefore allow both workers to pass without any problem, even though the fourth worker would not be adequately equipped for performing the specific activity.

Hence, on the basis of what has just been described, the system according to US 2004/0100384 is not found to be completely reliable.

OBJECT AND ABSTRACT OF THE INVENTION

The object of the present invention is therefore that of providing a system for monitoring the utilization of personal protective equipment by workers in the workplace that is completely reliable.

The above object is achieved by the present invention in so far as it relates to a system for monitoring the utilization of personal protective equipment by workers in the workplace, according to that defined in the attached claims.

In particular, the system according to the present invention comprises:

- a set of first slave electronic modules, each of which is paired to a corresponding piece of personal protective equipment to be used in said workplace and is configured to store information that identifies said corresponding piece of personal protective equipment;
- a set of master electronic modules, each of which is paired to a corresponding worker working in said workplace and is configured to:
  - store information that identifies said corresponding worker,
  - form with corresponding first slave electronic modules that are paired to personal protective equipment with which said corresponding worker is equipped a corresponding Body Area Network (BAN), through which said corresponding first slave electronic modules communicate exclusively with said master electronic module,
  - acquire the information stored by the corresponding first slave electronic modules from said corresponding first slave electronic modules through the corresponding Body Area Network (BAN), and
  - store the information acquired from said corresponding first slave electronic modules;
- a set of monitoring devices, each of which is arranged in a corresponding position in the workplace and is configured to acquire from the master electronic modules present in a corresponding acquisition area the information stored by said master electronic modules; and
- a central control and monitoring unit connected to the monitoring devices and configured to acquire from the monitoring devices the information that said monitoring devices acquire from the master electronic modules.

Conveniently, each monitoring device can be configured to periodically interrogate the master electronic modules present in the corresponding acquisition area to acquire the information stored by said master electronic modules from said master electronic modules.

Furthermore, according to a first preferred embodiment of present invention:

- for each piece of personal protective equipment, the corresponding first slave electronic module is coupled to a corresponding first sensor that is coupled to said piece of personal protective equipment and is configured to supply said corresponding first slave electronic module with a signal that indicates whether said piece of personal protective equipment is worn by a worker;
- for each piece of personal protective equipment, the corresponding first slave electronic module is configured to detect whether said piece of personal protective equipment is worn by a worker, on the basis of the signal supplied by the corresponding first sensor; and
- each first slave electronic module is configured to communicate, through the Body Area Network (BAN), with the master electronic module paired to the worker who is equipped with the corresponding piece of personal protective equipment only if said corresponding piece of personal protective equipment is worn by said worker.

Alternatively, according to a second preferred embodiment of the present invention:

- for each piece of personal protective equipment, the corresponding first slave electronic module is coupled to a corresponding first sensor that is coupled to said piece of personal protective equipment and is configured to supply said corresponding first slave electronic module with a signal that indicates whether said piece of personal protective equipment is worn by a worker;

for each piece of personal protective equipment, the corresponding first slave electronic module is configured to detect whether said piece of personal protective equipment is worn by a worker, on the basis of the signal supplied by the corresponding first sensor;

each first slave electronic module is configured to inform, through the Body Area Network (BAN), the master electronic module paired to the worker who is equipped with the corresponding piece of personal protective equipment whether said corresponding piece of personal protective equipment is worn by said worker; and if a piece of personal protective equipment with which the corresponding worker is equipped is not worn by said corresponding worker, each master electronic module is configured to generate an alarm and to generate and store information concerning said piece of personal protective equipment not worn by said corresponding worker.

Preferably, each first slave electronic module is also configured to store maintenance/overhaul information regarding the corresponding piece of personal protective equipment and each master electronic module is configured to:

also acquire maintenance/overhaul information from the corresponding first slave electronic modules, through the corresponding Body Area Network (BAN);

detect a first hazardous situation for the corresponding worker on the basis of the maintenance/overhaul information acquired from the corresponding first slave electronic modules;

if said first hazardous situation is detected, generate an alarm; and if said first hazardous situation is detected, generate and store information concerning said detected first hazardous situation.

Preferably, the system can also comprise:

a set of second sensors, each of which is paired to a corresponding worker working in said workplace, and is configured to detect physical parameters representing the operating conditions in which said corresponding worker works; and a set of second slave electronic modules, each of which is coupled to a corresponding second sensor and is configured to acquire the physical parameters detected by the corresponding second sensor from said corresponding second sensor and to store information concerning the physical parameters acquired from said corresponding second sensor.

In this case, each master electronic module can be further configured to:

form the corresponding Body Area Network (BAN) also with corresponding second slave electronic modules that are coupled to second sensors paired to the corresponding worker, through said corresponding Body Area Network (BAN) said corresponding second slave electronic modules communicating exclusively with said master electronic module;

acquire the information stored by the corresponding second slave electronic modules from said corresponding second slave electronic modules, through the corresponding Body Area Network (BAN); and store the information acquired from said corresponding second slave electronic modules.

Furthermore, each master electronic module can also be conveniently configured to:

detect a second hazardous situation for the corresponding worker on the basis of the information acquired from said corresponding second slave electronic modules;

if said second hazardous situation is detected, generate an alarm; and if said second hazardous situation is detected, generate and store information concerning said second hazardous situation detected.

Conveniently, each second slave electronic module comprises a corresponding active RFID tag.

Expediently, the corresponding Body Area Network (BAN) for each master electronic module is a wireless network.

Furthermore, the workplace can comprise a specific work area that can only be entered by workers who are authorized to enter said specific work area and, for safety reasons, are equipped with the personal protective equipment necessary to enter said specific work area. In this case, the set of monitoring devices comprises a gate device that is destined, in use, to be placed near to an entrance of the specific work area and is configured to check, on the basis of the information acquired from the master electronic modules present in the corresponding acquisition area, that the workers who pass through said entrance are authorized to enter said specific work area and are equipped with the personal protective equipment necessary to enter said specific work area.

Preferably, said gate device is further configured to:

store a list of the workers authorized to enter the specific work area;

store a list of the personal protective equipment necessary to enter said specific work area;

check, on the basis of the information acquired from the master electronic modules present in the corresponding acquisition area and the lists stored by said gate device, that the workers who pass through said entrance are authorized to enter said specific work area and are equipped with the personal protective equipment necessary to enter said specific work area;

detect, on the basis of the information acquired from the master electronic modules present in the corresponding acquisition area and the lists stored by said gate device, a first presence at said entrance of a worker not authorized to enter the specific work area;

if the first presence is detected, generate an alarm;

if the first presence is detected, generate first information concerning said detected first presence;

detect, on the basis of the information acquired from the master electronic modules present in the corresponding acquisition area and the lists stored by said gate device, a second presence at said entrance of a worker authorized to enter the specific work area who is not equipped with the personal protective equipment necessary to enter said specific work area;

if the second presence is detected, generate an alarm; and if the second presence is detected, generate second information concerning said detected second presence.

Furthermore, the central control and monitoring unit is also configured to acquire the first information and the second information generated by the gate device from said gate device.

Conveniently, said gate device can be further configured to:

detect, on the basis of the information acquired from the master electronic modules present in the corresponding acquisition area and the lists stored by said gate device, a third presence at said entrance of a worker authorized to enter the specific work area and equipped with the personal protective equipment necessary to enter said specific work area; and command the automatic opening of the entrance if the third presence is detected.

Furthermore, the workplace can comprise a hazardous area where only specific workers equipped with specific personal protective equipment may work. In this case, the set of monitoring devices comprises a specific monitoring device that is destined, in use, to be placed in said hazardous area and is configured to check, on the basis of the information acquired from the master electronic modules present in the corresponding acquisition area, that the specific workers equipped with the specific personal protective equipment are present in said hazardous area.

Preferably, said specific monitoring device is further configured to:

store a list of the specific workers;

store a list of the specific personal protective equipment;

check, on the basis of the information acquired from the master electronic modules present in the corresponding acquisition area and the lists stored by said specific monitoring device, that the specific workers equipped with the specific personal protective equipment are present in said hazardous area;

detect, on the basis of the information acquired from the master electronic modules present in the corresponding acquisition area and the lists stored by said specific monitoring device, a fourth presence in the hazardous area of a worker who is not one of the specific workers;

if the fourth presence is detected, generate an alarm;

if the fourth presence is detected, generate third information concerning said detected fourth presence;

detect, on the basis of the information acquired from the master electronic modules present in the corresponding acquisition area and the lists stored by said specific monitoring device, a fifth presence in the hazardous area of one of the specific workers who is not equipped with the specific personal protective equipment;

if the fifth presence is detected, generate an alarm; and if the fifth presence is detected, generate fourth information concerning said detected fifth presence.

Furthermore, the central control and monitoring unit is also configured to acquire the third information and the fourth information generated by the specific monitoring device from said specific monitoring device.

Conveniently, said hazardous area can be an area where a specific work activity is performed, the specific workers can be workers authorized to carry out said specific work activity and the specific personal protective equipment can be personal protective equipment necessary, for safety reasons, to carry out said specific work activity.

Expediently, a specific apparatus can be present in said hazardous area, the specific workers can be workers authorized to use said specific apparatus and the specific personal protective equipment can be personal protective equipment necessary, for safety reasons, to use said specific apparatus.

Furthermore, the system can also comprise a set of alarm devices, each of which is configured to:

detect a master electronic module present in a corresponding alarm area;

if the presence of a master electronic module is detected in the corresponding alarm area, detect a third hazardous situation for the worker paired to said detected master electronic module; and if the third hazardous situation is detected, generate an alarm.

Preferably, each alarm device is further configured to periodically interrogate any possible master electronic modules present in the corresponding alarm area to detect the presence of a master electronic module in the corresponding alarm area.

Conveniently, each alarm device can be coupled to corresponding machinery present in the workplace and said detected third hazardous situation can be indicative of a potential collision between said machinery and the worker paired to the detected master electronic module caused by said worker being excessively close to said machinery.

Preferably, each alarm device is further configured to generate alarm information concerning the third hazardous situation if said third hazardous situation is detected, and the central control and monitoring unit is connected to the alarm devices by means of a first communications network and is further configured to acquire from each alarm device, through said first communications network, the alarm information generated by said alarm device, said first communications network being comprised in the set formed by: a wireless network, a wired network, and a mixed wired/wireless network.

Conveniently, each alarm device comprises a corresponding RFID reader.

Furthermore, the central control and monitoring unit can be conveniently connected to the monitoring means by means of a second communications network comprised in the set formed by: a wireless network, a wired network, and a mixed wired/wireless network.

Preferably, the central control and monitoring unit is further configured to:

store all the information acquired;

generate and keep up-to-date a corresponding safety status for each worker, on the basis of all the acquired information; and provide a user with the generated safety statuses by means of a user interface.

Conveniently, the central control and monitoring unit is further configured to:

determine, for each worker, a corresponding position inside the workplace; and also provide a user with the positions of the determined workers, by means of the user interface.

Preferably, the central control and monitoring unit can also be connected to each master electronic module by means of a third communications network comprised in the set formed by a wireless network and a mixed wired/wireless network.

Conveniently, the central control and monitoring unit can also be configured to periodically acquire from each master electronic module, through the third communications network, the information stored by said master electronic module.

Conveniently, each master electronic module can be further configured to periodically provide the central control and monitoring unit, through the third communications network, the information stored by said master electronic module.

Lastly, each master electronic module conveniently comprises a corresponding active RFID tag, each first slave electronic module conveniently comprises a corresponding active RFID tag and each monitoring device conveniently comprises a corresponding RFID reader.

BRIEF DESCRIPTION OF DRAWINGS

For a better understanding of the present invention, some preferred embodiments, provided by way of non-limitative example, will now be illustrated with reference to the accompanying drawings (not to scale), where.

DETAILED DESCRIPTION OF PREFERRED EMBODIMENTS ON THE INVENTION

Figure 1A:
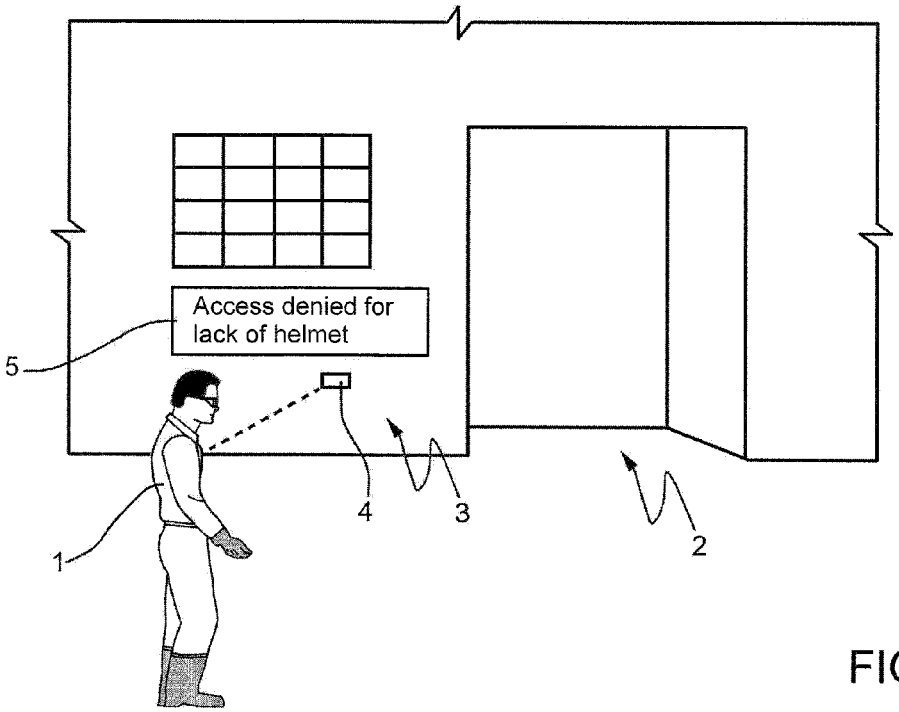
FIGS. 1A and 1B show an example operating scenario where use is made of the present invention.

The following description is provided to enable an expert in the field to embody and use the invention. Various changes to the preferred embodiments presented will be immediately obvious to experts and the generic principles divulged herein could be applied to other embodiments and applications without however leaving the scope of protection of the present invention.

Therefore, the present invention should not be intended as limited to just the embodiments described and illustrated, but be accorded the broadest scope of protection consistent with the principles and characteristics presented herein and defined in the attached claims.

According to the present invention, a system is provided for monitoring the utilization of personal protective equipment (PPE) by workers in the workplace.

In particular, the workplace can include one or more work areas and, for each work area, one or more respective entrances to said work area through which only the respective workers authorized to enter said work area can pass.

Furthermore, in each work area, the respective authorized workers can only gain access if equipped with the respective first personal protective equipment (PPE) necessary, for safety reasons, to work in said work area.

For example, the workplace could be a construction site that represents a single work area that can only be entered by authorized workers equipped with first personal protective equipment such as safety helmet, safety footwear, gloves etc.

Furthermore, in the workplace specific work activities can only be performed by respective authorized workers.

In particular, each specific work activity can be performed by the respective authorized workers only if equipped with the respective second personal protective equipment (PPE) necessary, for safety reasons, to carry out said specific work activity.

For example, the specific work activities could comprise the activity of welding, which can only be performed by authorized workers equipped with second personal protective equipment such as safety goggles, protective mask, safety clothing, etc.

Thus, each worker is given, normally by a safety manager of the workplace, respective personal protective equipment according to the work areas where said worker must work and according to the specific work activities that said worker must perform.

It is wished to draw attention to the fact that, for simplicity of description and without any loss of generality, explicit reference has been and shall be made to a construction site as the workplace in describing the present invention. In any case, it is wished to underline the fact that the present invention can be made use of in other types of workplace, such as, for example, underwater sites or aboard waterborne craft, industrial plant including cisterns and/or where potentially hazardous substances are used, etc., where the form, the type and quantity of personal protective equipment (PPE) used can also be considerably different from that of the PPE used in a construction site.

The system according to the present invention comprises:

- a set of master electronic modules (hereafter, also referred to as just master modules for simplicity) each paired to a corresponding worker and containing, or rather storing, respective information concerning said corresponding worker; and
- a set of first slave electronic modules (hereafter, also referred to as just first slave modules for simplicity) each of which is coupled to a corresponding piece of personal protective equipment (PPE) to use in the workplace and contains, or rather stores, respective information concerning said corresponding item of PPE.

In particular, the information stored in each master module and concerning the corresponding worker includes identification information that identifies said corresponding worker and, preferably, also further information that could regard personal data, date of hiring, job and work duties of the corresponding worker, work areas that said corresponding worker can enter, work activities that said corresponding worker can perform, etc.

Similarly, the information stored in each first slave module and concerning the corresponding item of PPE includes identification information that identifies said corresponding item of PPE and, preferably, also maintenance/overhaul information regarding said corresponding item of PPE, for example regarding maintenance and/or overhaul operations carried out or to be carried out on the corresponding item of PPE, corresponding dates of said maintenance and/or overhaul operations carried out or to be carried out on the corresponding item of PPE, expiry date of the corresponding item of PPE, etc.

Furthermore, each master electronic module is configured to form a corresponding wireless network of the "Body Area Network" (BAN) type, with corresponding first slave electronic modules paired to the PPE with which the corresponding worker is equipped in such a way that said corresponding first slave electronic modules only communicate with said master electronic module.

In detail, when each BAN is formed and, preferably, on a periodic basis, the corresponding master module interrogates, through said BAN, the corresponding first slave modules to acquire respective information from them concerning the corresponding PPE, in particular the respective identification information that identifies the corresponding items of PPE, said corresponding master module then storing the information acquired from the corresponding first slave modules and, preferably, also the respective changes in this information over time.

In this way, each master electronic module, in use, stores information that allows the identification of both the corresponding worker and the PPE with which said corresponding worker is effectively equipped.

Furthermore, for each item of PPE, the corresponding first slave module is preferably coupled to a corresponding first sensor paired to said item of PPE and configured to provide said corresponding first slave module with a signal indicating whether said item of PPE is really worn by a worker. Then, for each item of PPE, the corresponding first slave module is configured to detect, on the basis of the signal provided by the corresponding first sensor, whether said item of PPE is really worn by a worker.

For example, the first sensors can be conveniently based on known photoelectric detection technologies and/or can comprise pressure and/or light and/or capacity and/or magnetic sensors.

Therefore, in a first preferred embodiment of the present invention, each first slave module is configured to communicate, through the BAN, with the master module paired to the worker who is equipped with the corresponding item of PPE to which said first slave module is paired only if said corresponding item of PPE is really worn by said worker.

Instead, in a second preferred embodiment of the present invention, each first slave module is configured to inform, through the BAN, the master module paired to the worker who is equipped with the corresponding item of PPE to which said first slave module is paired, whether said corresponding item of PPE is really worn by said worker or not.

Thus, according to said second preferred embodiment of the present invention, if an item of PPE with which the corresponding worker is equipped is not worn by said corresponding worker, each master module is configured to, generate an alarm, for example an audible alarm, and generate and store non-compliance information concerning said item of PPE not worn by said corresponding worker.

In the following, for simplicity of description, explicit reference will be made to the first or to the second preferred embodiment of the present invention only in the case where hardware/software functionality is described that regards only the first or the second preferred embodiment respectively, whilst where no explicit reference is made to either of the two preferred embodiments, it remains understood that the described hardware/software functionality regards both of the preferred embodiments.

Preferably, the corresponding master module in each BAN is configured to:

also acquire from the corresponding first slave modules the respective maintenance/overhaul information regarding the corresponding PPE;

detect a first hazardous situation for the corresponding worker on the basis of the maintenance/overhaul information acquired from the corresponding first slave modules;

if said first hazardous situation is detected, generate an alarm, for example an audible alarm; and if said first hazardous situation is detected, generate and store first hazard information concerning said first hazardous situation detected.

For example, a master electronic module can conveniently detect a first hazardous situation for the corresponding worker if it detects, on the basis of the maintenance/overhaul information acquired from the corresponding first slave modules of the corresponding BAN, that an item of PPE with which said corresponding worker is equipped has expired and/or needs maintenance and/or overhaul (for example if it detects that an oxygen tank is empty and/or that the mask filter is saturated, etc.).

Furthermore, the system according to the present invention can preferably also comprise:

a set of second sensors paired to the corresponding workers and configured to detect, or rather measure, physical parameters representing operating conditions where said corresponding workers work; and a set of second slave electronic modules (hereafter, also referred to as just second slave modules for simplicity), each coupled to a corresponding second sensor and configured to provide the physical parameters detected by said corresponding second sensor to the master module paired to the worker to whom said corresponding second sensor is also paired.

In particular, the second sensors could comprise sensors configured to measure the body temperature and/or blood pressure and/or heartbeat of the corresponding workers and/or to detect whether the corresponding workers are breathing and/or to measure the temperature and/or the outside pressure around the corresponding workers and/or to detect the presence of toxic gases around the corresponding workers, etc.

In detail, each master electronic module is configured to form the corresponding BAN also with the second slave electronic modules that are coupled to second sensors paired to the corresponding worker in such a way that said second slave electronic modules only communicate with said master electronic module.

Furthermore, when each BAN is formed and, preferably, on a periodic basis, the corresponding master module also interrogates, through said BAN, the second slave modules coupled to the second sensors paired to the corresponding worker to acquire from said second slave modules the physical parameters detected by said second sensors, said corresponding master module then storing the physical parameters acquired from said second slave modules and, preferably, also the respective changes in said physical parameters over time.

In this way, each master electronic module, in use, "knows" the operating conditions where the corresponding worker is working.

Conveniently, the corresponding master module in each BAN can be configured to:

detect a second hazardous situation for the corresponding worker on the basis of the physical parameters acquired from second slave modules coupled to the second sensors paired to the corresponding worker;

if said second hazardous situation is detected, generate an alarm, for example an audible alarm; and if said second hazardous situation is detected, generate and store second hazard information concerning said second hazardous situation detected.

For example, a master electronic module can conveniently detect a second hazardous situation for the corresponding worker if it detects, on the basis of the physical parameters acquired from the second slave modules of the corresponding BAN coupled to the second sensors paired to the corresponding worker, that said corresponding worker is not breathing and/or has a body temperature that is too high/low and/or has no heartbeat, etc.

Preferably, the master electronic modules and the first and second slave electronic modules are active RFID tags equipped with respective power supply means. The choice of using active RFID tags instead of passive RFID tags depends on the fact that the latter have significant limitations (with current-day technology) regarding interrogation distance and angle. Conveniently, both the active and the passive active RFID tags can comprise respective hardware/software modules configured/programmed in such a way that said active RFID tags are able to implement the functionality, described previously and also in the following, of the master electronic modules and the first and second slave electronic modules respectively.

Conveniently, each master module can be paired to garments of the corresponding worker, for example to the personal overalls of the corresponding worker or a utility belt of the corresponding worker, or to a tool/equipment or even an item of PPE with which said corresponding worker is equipped, for example the safety helmet of said corresponding worker, or a pass or badge of said corresponding worker, etc.

Furthermore, the system according to the present invention also comprises:

a set of monitoring devices, each arranged in a corresponding position in the workplace and configured to interrogate the master modules present in a corresponding acquisition area to acquire the information stored by said master modules and, preferably, also the physical parameters stored by said master modules.

In particular, the monitoring devices are configured to periodically interrogate the master modules present in the corresponding acquisition area.

In detail, each monitoring device can be conveniently configured to:

in the second preferred embodiment of the present invention, acquire from master modules present in the corresponding acquisition area the non-compliance information stored by said master modules and possibly generate an alarm on the basis of said acquired non-compliance information, for example because a worker present in the work area monitored by said monitoring device is not wearing an item of PPE necessary for working in said monitored work area; and/or acquire from master modules present in the corresponding acquisition area the first hazard information stored by said master modules and possibly generate an alarm on the basis of said acquired first hazard information, for example because a worker present in the work area monitored by said monitoring device is equipped with an item of PPE that needs maintenance; and/or acquire from master modules present in the corresponding acquisition area the second hazard information stored by said master modules and possibly generate an alarm on the basis of said acquired second hazard information, for example because a worker present in the work area monitored by said monitoring device shows physical problems.

Preferably, the set of monitoring devices comprises a set of gate devices, each of which is arranged near to a corresponding entrance to a corresponding specific work area in the workplace and is configured to check, on the basis of the information acquired from the master modules present in the corresponding acquisition area, that only workers who are authorized to enter said corresponding specific work area and who are equipped with the PPE necessary to work in said corresponding specific work area pass through said corresponding entrance.

In particular, in use, each gate device preferably stores:

a corresponding first list containing identification data of the workers authorized to enter said corresponding specific work area; and a corresponding second list containing identification data of the PPE necessary to work in said corresponding specific work area.

Furthermore, in use, each gate device also preferably checks that only workers who are authorized to enter said corresponding specific work area and are equipped with the PPE necessary to work in said corresponding specific work area pass through the corresponding entrance, by comparing the information acquired from the master modules present in the corresponding acquisition area with the identification data contained in the corresponding first list and in the corresponding second list.

Furthermore, each gate device can, again preferably, signal an increasing level of alarm in function of the events that are detected inside the corresponding specific work area (for example, the outbreak of fire), signaling the need to enter said corresponding specific work area only after being equipped with additional and/or different PPE (for example, respirators, fire extinguishers, etc.) instead of the PPE normally required and/or indicating the store-room for said PPE near to the corresponding entrance to said corresponding specific work area.

In detail, if a gate device, in use, determines the presence of a worker not authorized to enter the corresponding specific work area or a worker authorized to enter said corresponding specific work area who however is not adequately equipped for said corresponding specific work area, said gate device can generate an audible and/or visual alarm and conveniently display the missing PPE on a screen.

Figure 1B:
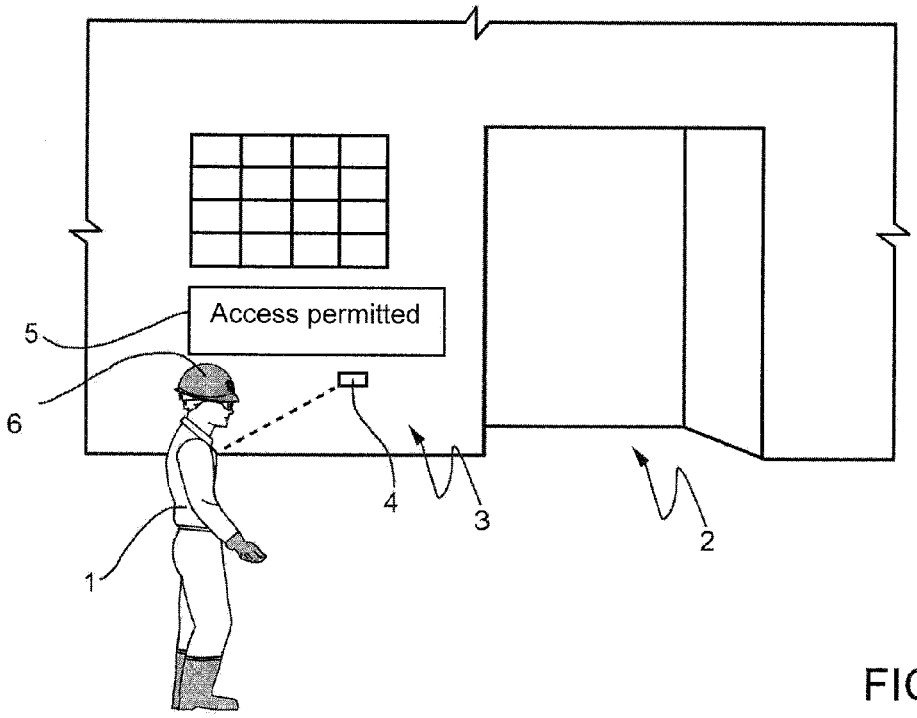

Regarding what has just been described, FIG. 1A and FIG. 1B show example operating scenarios that make use of the present invention.

In particular, FIG. 1A shows a worker 1 who is paired to a master module (not shown in FIG. 1A), which can be created, for example, by means of an active master RFID tag integrated in a personal badge for the worker 1 and kept by said worker 1 in a pocket of the respective overalls. Alternatively, said active master RFID tag can be paired to the utility belt worn by the worker 1. As shown in FIG. 1A, the worker 1 is approaching an entrance 2 of a specific work area to which only authorized workers equipped with a safety helmet can enter. A gate device 3 is installed in the vicinity of the entrance 2 and comprises an RFID reader 4 that interrogates (as shown by a dashed line in FIG. 1A) the master RFID tag paired to the worker 1 to determine whether said worker 1 is authorized to enter the specific work area and if said worker 1 is equipped with a safety helmet. The worker 1, although being authorized to enter the specific work area, is not equipped with a safety helmet and therefore the gate device 3, on the basis of the information acquired from the master RFID tag paired to the worker 1, determines that said worker 1 is authorized to enter the specific work area, but that said worker 1 is not equipped with a safety helmet. In consequence, the gate device 3 generates a visual alarm on a screen 5 to warn the worker 1 that he/she cannot access the specific work area because he/she is not equipped with a safety helmet.

In addition, FIG. 1B shows the worker 1 again after he/she has put on a safety helmet 6 paired to a respective first slave module (not shown in FIG. 1A), which can be created, for example, by means of an active slave RFID tag integrated inside the safety helmet 6 and that forms a BAN with the master RFID tag paired to said worker 1. In this case, the gate device 3, after having again interrogated the master RFID tag paired to the worker 1, allows said worker 1 to enter the specific work area.

However, the gate device 3 could be conveniently connected to an automatic door of the entrance 2 to control that it is only opened in the situation where the presence of workers who are authorized to enter the specific work area and who are properly equipped with a safety helmet is detected.

Conveniently, the gate devices can be configured to also acquire from the master modules present in the corresponding acquisition area the changes over time of the information stored by said master modules and the changes over time of the physical parameters stored by said master modules.

Preferably, the set of monitoring devices can also comprise a set of specific monitoring devices disseminated in the workplace to periodically acquire the information stored by the master modules present in the corresponding acquisition area and, preferably, also the physical parameters stored by said master modules.

Conveniently, the specific monitoring devices can be configured to also periodically acquire from the master modules present in the corresponding acquisition area the changes over time of the information stored by said master modules and the changes over time of the physical parameters stored by said master modules.

Said specific monitoring devices can be conveniently used to monitor hazardous areas in the workplace and/or the carrying out of specific work activities. In fact, said specific monitoring devices can be positioned in said hazardous areas and/or in specific areas where said specific work activities must be performed and/or in proximity to specific equipment to use for performing said specific work activities in such a way that said specific monitoring devices can check that the workers present in the hazardous areas are authorized and adequately equipped for said hazardous areas and/or that the specific work activities are effectively carried out by workers authorized and adequately equipped to carry out said specific work activities and/or that the specific equipment is effectively used by workers authorized and adequately equipped to utilize said specific equipment.

In particular, each specific monitoring device, in use, preferably stores:

a corresponding first list containing identification data of the workers authorized to stay in a corresponding hazardous area and/or to carry out a corresponding specific work activity and/or to use corresponding specific equipment to carry out said corresponding specific work activity; and a corresponding second list containing identification data of the PPE necessary to stay in said corresponding hazardous area and/or to carry out said corresponding specific work activity and/or to use said corresponding specific equipment.

Furthermore, each specific monitoring device, again preferably, in use, checks that in the corresponding hazardous area the workers present are authorized and adequately equipped to stay in said corresponding hazardous area, and/or that the corresponding specific work activity is effectively carried out by workers authorized and adequately equipped to carry out said corresponding specific work activity, and/or that the corresponding specific equipment is effectively used by workers authorized and adequately equipped to use said corresponding specific equipment, by comparing the information acquired from the master modules present in the corresponding acquisition area with the identification data contained in the corresponding first list and in the corresponding second list.

Conveniently, for each specific monitoring device, the corresponding acquisition area can coincide with the corresponding hazardous area.

In detail, if a specific monitoring device, in use, determines the presence in the corresponding hazardous area of an unauthorized worker, and/or the presence of a worker not authorized to carry out the corresponding specific work activity, and/or the presence of a worker not authorized to use the corresponding specific equipment, or a worker authorized to stay in the corresponding hazardous area who, however, is not adequately equipped, and/or the presence of a worker authorized to carry out the corresponding specific work activity and/or to use the corresponding specific equipment who, however, is not adequately equipped to carry out said corresponding specific work activity and/or to use said specific equipment, said specific monitoring device can generate an audible and/or visual alarm and conveniently display the missing PPE on a screen.

Preferably, each monitoring device comprises a respective RFID scanner or reader, respective power supply means and a respective hardware/software module configured/programmed in such a way that the monitoring device is able to implement the respective functionality, described previously and also in the following.

Furthermore, the system according to the present invention also comprises a central control and monitoring unit connected, by means of a wireless network or wired network or mixed wired/wireless network, to each monitoring device and configured to acquire from the monitoring devices:

all of the information that said monitoring devices acquire from the master modules;

preferably, also the physical parameters that said monitoring devices acquire from the master modules; and conveniently, also the changes over time of the information stored by the master modules and the changes over time of the physical parameters stored by the master modules that said monitoring devices acquire from the master modules.

In particular, the central control and monitoring unit is also configured to store the information acquired from the monitoring devices and, consequently, to generate and keep up-to-date, a corresponding safety status for each worker, on the basis of said information acquired from the monitoring devices.

Preferably, the central control and monitoring unit is also configured to:

determine, for each worker, a corresponding position inside the workplace on the basis of the position of the monitoring device from which it has most recently acquired information concerning said worker and/or on the basis of any known method of two/three-dimensional radio localization (for example, a known triangulation method) based of the received RFID signals and the positions of the monitoring devices in the acquisition areas where said worker, or rather the corresponding master module, is present; and associate the safety status of each worker with the corresponding position determined.

Conveniently, the system according to the present invention can also comprise a wireless or wired/wireless network to connect the master modules to the central control and monitoring unit;

each master module can be further configured to periodically transmit to the central control and monitoring unit, through said wireless or wired/wireless network, the corresponding stored information, the corresponding stored physical parameters, the first hazard information and second hazard information and, in the second preferred embodiment of the present invention, the non-compliance information;

the central control and monitoring unit can also be configured to:

periodically interrogate, through said wireless network, each master module to acquire the corresponding stored information, the corresponding stored physical parameters, the first hazard information and second hazard information and, in the second preferred embodiment of the present invention, the non-compliance information, store all of the information received from the master modules, generate, store and keep up-to-date, for each worker, the corresponding safety status also on the basis of all the information received/acquired directly from the master modules, determine, for each worker, the corresponding position inside the workplace also on the basis of any known method of two/three-dimensional radio localization for wireless networks, and store the changes over time of the safety status and of the positions of each worker.

Moreover, the central control and monitoring unit can conveniently comprise a user interface to provide a user, for example a safety manager of the workplace, with the safety status of each worker, the position of each worker inside the workplace, the changes over time of the safety status and the positions of each worker and any alarms generated by the monitoring devices and/or the master modules. Furthermore, a user can enter data through the user interface that the central control and monitoring unit can conveniently use to update/change the first and the second lists of gate devices and the specific monitoring devices.

Furthermore, the central control and monitoring unit can be conveniently realized by means of a fixed or portable computer configured/programmed to implement the functionality of the central control and monitoring unit described previously and also in the following.

Figure 2:
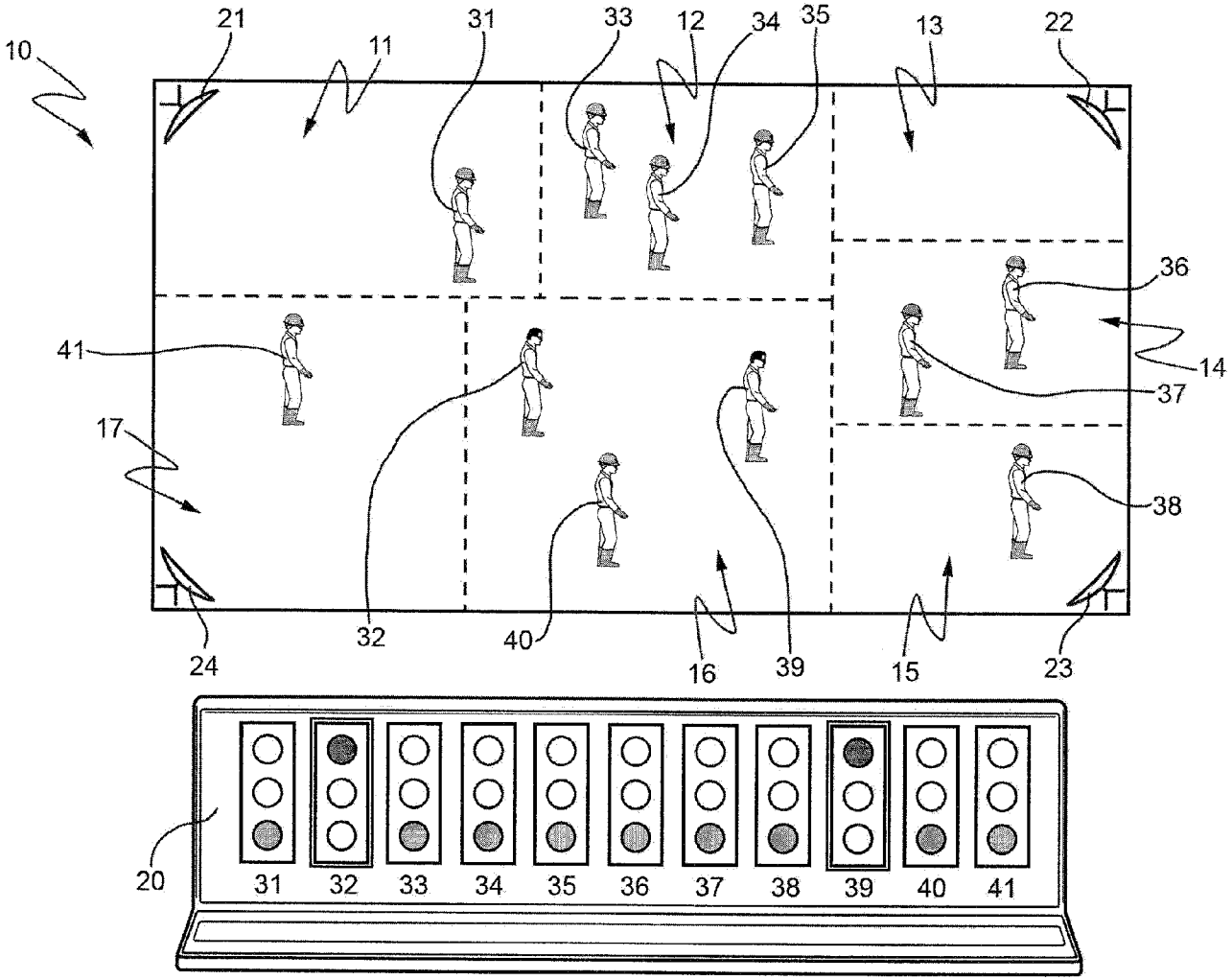
FIG. 2 schematically shows an example of embodiment of the present invention.

With regard to what has just been described, FIG. 2 schematically shows an example of embodiment of the present invention.

In particular, FIG. 2 shows a workplace 10 comprising seven work areas, respectively indicated by reference numerals 11, 12, 13, 14, 15, 16 and 17, where eleven workers respectively indicated by reference numerals 31, 32, 33, 34, 35, 36, 37, 38, 39, 40 and 41, work, each of whom is paired to a corresponding master module (not shown in FIG. 2) and equipped with corresponding PPE paired to respective first slave modules (not shown in FIG. 2) that, with said corresponding master module, form a corresponding wireless BAN.

In detail, workers 31, 33, 34, 35, 36, 37, 38, 40 and 41 are equipped with safety helmet, gloves and safety footwear, while workers 32 and 39 are only equipped with gloves and safety footwear and therefore do not have a safety helmet.

Furthermore, there are four monitoring devices in the workplace 10, respectively indicated by reference numerals 21, 22, 23 and 24, and a central control and monitoring unit 20 connected to said monitoring devices 21, 22, 23 and 24, for example by means of a wired LAN network (not shown in FIG. 2), and constituted by means of an opportunely programmed laptop.

In use, each of the monitoring devices 21, 22, 23 and 24 periodically interrogates the master modules present in a respective acquisition area, acquires information from the latter concerning the corresponding workers and the PPE with which said corresponding workers are equipped and sends the information acquired from the master modules to the central control and monitoring unit 20 which generates, for each worker, a corresponding safety status on the basis of the information received from the monitoring devices 21, 22, 23 and 24, which is displayed on a screen (i.e. on the screen of the laptop) in order for the generated safety statuses to kept under control by a safety manager (not shown in FIG. 2) of the workplace 10.

Therefore, as it is necessary to be equipped with safety helmet, safety footwear and gloves in order to work in the workplace 10, the central control and monitoring unit 20 detects, on the basis of the information received from the monitoring devices 21, 22, 23 and 24 that workers 32 and 39 do not have a safety helmet and consequently indicates on the screen the fact that said workers 32 and 39 are not adequately equipped to work in the workplace 10, in particular the fact that said workers 32 and 39 do not have a safety helmet.

In this way, the safety manager of the workplace 10 can assess over time whether the non compliance of workers 32 and 39 to the safety measures is temporary or continual and whether it is due to carelessness or causes independent of the will of workers 32 and 39 and can therefore decided whether or not to take measures against them, in accordance with civil and contractual regulations, so that this mistake is no longer repeated in the future.

In this sense, the system according to the present invention thus enables support in tutoring workers with regard to safety in the workplace.

In the unfortunate case where an accident occurs, the logging of monitoring data by the central control and monitoring unit can be of help in determining the associated responsibilities.

Furthermore, the central control and monitoring unit 20 can conveniently determine, for each worker, a corresponding position inside the workplace 10 on the basis of any known method of two/three-dimensional radio localization (for example, a known triangulation method) and display a map of the workplace 10 on the screen in which the positions of the workers 31, 32, 33, 34, 35, 36, 37, 38, 39, 40 and 41 are highlighted.

Furthermore, the system according to the present invention can preferably also comprise a set of alarm devices, each configured to:

- detect the presence of master modules, or rather workers, in a corresponding alarm area; and
- generate an audible and/or visual alarm when the presence of master modules is detected.

In particular, each alarm device is configured to periodically interrogate the master modules present in a corresponding alarm area in order to detect their presence, or rather each alarm device is configured to detect, if it receives a response from a master module to an interrogation made, the presence of said master module in the corresponding alarm area and generate an audible and/or visual alarm.

For example, the alarm devices can be conveniently mounted on mobile or fixed machinery, such as, for example, earthmovers, forklift trucks, excavators, presses, etc., in order to generate alarms in cases of potential collision between a worker and a machine caused by said worker being excessively close to said machine.

Furthermore, the central control and monitoring unit is preferably connected by means of a wireless network or wired network or mixed wired/wireless network to each alarm device and is further configured to:

- acquire from each alarm device information concerning the corresponding alarms generated, such as, for example, the identification information of a worker who has caused an alarm, which the alarm device acquires from the respective master module paired to said worker;
- store the information acquired from the alarm devices;
- generate, store and keep up-to-date, the corresponding safety status for each worker, also on the basis of said information acquired from the alarm devices;
- conveniently, provide a user with information acquired from the alarm devices, by means of the user interface;
- conveniently, determine a position inside the workplace of a worker who has caused an alarm on the basis of the position inside the workplace of the alarm device that has generated said alarm; and
- conveniently, also provide the user with the position inside the workplace of a worker who has caused an alarm, by means of the user interface.

Preferably, each alarm device comprises a respective RFID scanner or reader, respective power supply means and a respective hardware/software module configured/programmed in such a way that the alarm device is able to implement the respective functionality previously described.

Ultimately, from a general standpoint, the system according to the present invention is a monitoring system that, by making use of a network of suitable devices disseminated in the workplace, is able to predict events that could cause accidents and hence possible injury.

In particular, the system is a supervised system that coordinates various mutually interacting hardware/software modules that share a common technological origin.

This common technological origin can conveniently be the active RFID technology, in particular, for example, the LNXessence RFID technology from AME, which is particularly suited to managing the various modules in an integrated manner and which is described in European Patent EP 1,209,615, the contents of which is incorporated herein for reference.

In alternative to the active RFID technology, other utilizable technologies, even if more expensive, are based on devices such as Personal Computer palm-tops, connected via a WiFi network and equipped with GPS for localization, and therefore able to store and process the same types of information and/or realize the same functionality previously described with regard to RFID technology.

The various modules that are integrated in the system perform different functions, of which:

1) the access control function, said function being very important for a whole series of control activities that are necessary in the workplace, such as checking personnel, working hours, safety management in the event of an accident, authorizations to carry out special tasks, etc.;
2) the control, monitoring and checking function for Personal Protective Equipment (PPE) that the safety manager of the workplace makes available to workers and which the workers are required to use in the appropriate manner; and
3) the man-machine anti-collision function, said function being very important given that one of the main causes of industrial accidents is represented by man-machine collision.

Therefore, on the basis of what has been previously described, in particular with regard to the man-machine anti-collision function, the system according to the present invention is able to:

automatically detect the positions of workers with regard to potential hazards present in the area where said workers carry out their work; and automatically intervene by implementing measures to reduce or in many cases prevent accidents.

The object of introducing an automatic system is that of effectively coping with situations where "human" management can prove inadequate, for example due to distraction, errors of judgment, tiredness, inexperience or whatever else that entails so-called "human error".

The advantages of the present invention can be immediately understood from the foregoing description.

In particular, a first advantage consists in the fact that the present invention enables creating a system for monitoring the utilization of personal protective equipment by workers that is completely reliable thanks to the use of the master modules, the first slave modules and the associated Body Area Networks (BANs) that enable, unlike the known art, the simultaneous and reliable identification of workers and the effective respective PPE with which the workers are equipped.

In fact, the master modules, as well as acting as Radio Frequency Identification (RFID) systems for the workers, enable constant monitoring of the correct utilization of PPE by the workers, thanks to the BAN-type connection with the first slave modules.

Thus, in conclusion, each master module has a dual function:

1) master of a Body Area Network (BAN) that collects information on the correct utilization of PPE by the corresponding worker; and
2) personal identification subsystem and unit for uploading data to the monitoring devices and the central control and monitoring unit.

Furthermore, another advantage consists in the fact that the present invention enables creating a system able to prevent accidents in the workplace thanks to the use both of the alarm devices and of the second sensors paired to the workers and the second slave modules that, in turn, are connected to the master modules of the workers through the corresponding BAN.

In fact, thanks to the alarm devices, the system according to the present invention enables preventing a worker coming into contact with fixed or mobile machines when they are in operation.

Furthermore, thanks to the second sensors paired to the workers and the second slave modules that, in turn, are connected to the master modules of the workers through the corresponding BAN, each master module is able to detect potentially hazardous situations in which the corresponding worker might find himself/herself, on the basis of the physical parameters detected by the second sensors paired to the corresponding worker.

Moreover, a further advantage consists in the fact that the present invention enables creating a system able to support tutoring of workers with regard to safety in the workplace.

In fact, the previously-described hardware/software architecture and the functionality of the system according to the present invention enable a safety manager of a workplace to constantly monitor the workers with regard to safety in the workplace, to always have the log of the behaviour of workers with regard to safety in the workplace at hand and therefore to define, on the basis of said log, the most appropriate strategies to continuously improve the behaviour of workers with regard to safety in the workplace.

Furthermore, in the unfortunate case where an accident occurs, the logging of monitoring data implemented through the present invention can constitute an aid in determining the associated responsibilities.

Finally, it is clear that various changes can be made to the present invention, all falling within the scope of protection of the invention defined in the attached claims.

The invention claimed is:

1. A system for monitoring utilization of personal protective equipment by workers in a workplace, comprising:

a set of first slave Radio Frequency Devices (RFIDs), each of which is paired to a corresponding piece of personal protective equipment to be used in said workplace and is configured to store information that identifies said corresponding piece of personal protective equipment;

a set of master RFIDs, each of which is paired to a corresponding worker working in said workplace and is configured to:

store information that identifies said corresponding worker, form with corresponding first slave RFI Ds that are paired to personal protective equipment with which said corresponding worker is equipped a corresponding Body Area Network (BAN), through which said corresponding first slave RFIDs communicate exclusively with said master RFIDs, acquire the information stored by the corresponding first slave RFIDs from said corresponding first slave RFIDs through the corresponding Body Area Network (BAN), and store the information acquired from said corresponding first slave RFIDs;

a set of monitoring RFID readers, each of which is arranged in a corresponding work area in the workplace and is configured to acquire from the master RFIDs present within the corresponding work area the information stored by said master RFIDs; and a central control and monitoring computer connected to the monitoring RFID readers and configured to acquire from the monitoring RFID readers the information that said monitoring RFID readers acquire from the master RFIDs, wherein, for each piece of personal protective equipment, the corresponding first slave RFID is coupled to a corresponding first sensor that is paired to said piece of personal protective equipment and is configured to supply said corresponding first slave RFID with a signal that indicates whether said piece of personal protective equipment is worn by a worker; and wherein, for each piece of personal protective equipment, the corresponding first slave RFID is configured to detect whether said piece of personal protective equipment is worn by the worker, on the basis of the signal supplied by the corresponding first sensor.

2. The system of claim 1, wherein each first slave RFID is configured to communicate, through the Body Area Network (BAN), with the master RFID paired to the worker who is equipped with the corresponding piece of personal protective equipment only if said corresponding piece of personal protective equipment is worn by said worker.

3. The system of claim 1, wherein each first slave RFID is configured to inform, through the Body Area Network (BAN), the master RFID paired to the worker who is equipped with the corresponding piece of personal protective equipment whether said corresponding piece of personal protective equipment is worn by said worker;

and wherein each master RFID is configured, if a piece of personal protective equipment with which the corresponding worker is equipped is not worn by said corresponding worker, to:

generate an alarm, and generate and store information concerning said piece of personal protective equipment not worn by said corresponding worker.

4. The system according to claim 1, wherein each first slave RFID is also configured to store maintenance and overhaul information regarding the corresponding piece of personal protective equipment;

and wherein each master RFID is configured to:

also acquire maintenance and overhaul information from the corresponding first slave RFIDs, through the corresponding Body Area Network (BAN);

detect a first hazardous situation for the corresponding worker on the basis of the maintenance and overhaul information acquired from the corresponding first slave RFIDs;

if said first hazardous situation is detected, generate an alarm; and if said first hazardous situation is detected, generate and store information concerning said first hazardous situation detected.

5. The system according to claim 1, further comprising:

a set of second sensors, each of which is paired to a corresponding worker working in said workplace and is configured to detect physical parameters representing the operating conditions in which said corresponding worker works; and a set of second slave RFIDs, each of which is coupled to a corresponding second sensor and is configured to acquire the physical parameters detected by the corresponding second sensor from said corresponding second sensor and to store information concerning the physical parameters acquired from said corresponding second sensor;

each master RFID being further configured to:

form the corresponding Body Area Network (BAN) also with corresponding second slave RFIDs that are coupled to second sensors paired to the corresponding worker, said corresponding second slave RFIDs communicating exclusively with said master RFID, through said corresponding Body Area Network (BAN);

acquire the information stored by the corresponding second slave RFIDs from said corresponding second slave RFIDs, through the corresponding Body Area Network (BAN); and store the information acquired from said corresponding second slave RFIDs.

6. The system of claim 5, wherein each master RFID is further configured to:

detect a second hazardous situation for the corresponding worker on the basis of the information acquired from said corresponding second slave RFIDs;

if said second hazardous situation is detected, generate an alarm; and if said second hazardous situation is detected, generate and store information concerning said second hazardous situation detected.

7. The system according to claim 1, wherein the workplace comprises a specific work area that can only be entered by workers who are authorized to enter said specific work area and, for safety reasons, are equipped with the personal protective equipment necessary to enter said specific work area;

the set of monitoring RFID readers comprising a gate RFID reader placed at an entrance of the specific work area and-configured to check, on the basis of the information acquired from the master RFIDs present in the corresponding work area, that the workers who pass through said entrance are authorized to enter said specific work area and are equipped with the personal protective equipment necessary to enter said specific work area.

8. The system of claim 7, wherein said gate RFID reader is further configured to:

store a list of the workers authorized to enter the specific work area;

store a list of the personal protective equipment necessary to enter said specific work area;

check, on the basis of the information acquired from the master RFIDs present in the corresponding work area and the lists stored by said gate RFID reader, that the workers who pass through said entrance are authorized to enter said specific work area and are equipped with the personal protective equipment necessary to enter said specific work area;

detect, on the basis of the information acquired from the master RFIDs present in the corresponding work area and the lists stored by said gate RFID reader, a first presence at said entrance of a worker not authorized to enter the specific work area;

if the first presence is detected, generate an alarm;

if the first presence is detected, generate first information concerning said detected first presence;

detect, on the basis of the information acquired from the master RFIDs present in the corresponding work area and the lists stored by said gate RFID reader, a second presence at said entrance of a worker authorized to enter the specific work area who is not equipped with the personal protective equipment necessary to enter said specific work area;

if the second presence is detected, generate an alarm; and if the second presence is detected, generate second information concerning said detected second presence;

the central control and monitoring computer being further configured to acquire the first information and the second information generated by the gate RFID reader from said gate RFID reader.

9. The system of claim 8, wherein said gate RFID reader is further configured to:

detect, on the basis of the information acquired from the master RFIDs present in the corresponding work area and the lists stored by said gate RFID reader, a third presence at said entrance of a worker authorized to enter the specific work area and equipped with the personal protective equipment necessary to enter said specific work area; and issue a command for the automatic opening of the entrance if the third presence is detected.

10. The system according to claim 1, wherein the workplace comprises a hazardous area in which only specific workers that are equipped with specific personal protective equipment can work;

the set of monitoring RFID readers comprising a specific monitoring RFID reader placed in said hazardous area and configured to check, on the basis of the information acquired from the master RFIDs present in the corresponding hazardous area, that the specific workers equipped with the specific personal protective equipment are present in said hazardous area.

11. The system of claim 10, wherein said specific monitoring RFID reader is further configured to:

store a list of the specific workers;

store a list of the specific personal protective equipment;

check, on the basis of the information acquired from the master RFIDs present in the corresponding hazardous area and the lists stored by said specific monitoring RFID reader, that the specific workers equipped with the specific personal protective equipment are present in said hazardous area;

detect, on the basis of the information acquired from the master RFIDs present in the corresponding hazardous area and the lists stored by said specific monitoring RFID reader, a fourth presence in the hazardous area of a worker who is not one of the specific workers;

if the fourth presence is detected, generate an alarm;

if the fourth presence is detected, generate third information concerning said detected fourth presence;

detect, on the basis of the information acquired from the master RFIDs present in the corresponding hazardous area and the lists stored by said specific monitoring RFID reader, a fifth presence in the hazardous area of one of the specific workers who is not equipped with the specific personal protective equipment;

if the fifth presence is detected, generate an alarm; and if the fifth presence is detected, generate fourth information concerning said detected fifth presence;

the central control and monitoring computer being further configured to acquire the third information and the fourth information generated by the specific monitoring RFID reader from said specific monitoring RFID reader.

12. The system according to claim 1, further comprising a set of alarm RFID reader, each of which is configured to:

detect a master RFIDs present in a corresponding alarm area;

if the presence of a master RFIDs is detected in the corresponding alarm area, detect a third hazardous situation for the worker paired to said detected master RFIDs; and if the third hazardous situation is detected, generate an alarm.

13. The system of claim 12, wherein each alarm RFID reader is further configured to generate alarm information concerning the third hazardous situation if said third hazardous situation is detected;

the central control and monitoring computer being connected to the alarm RFID readers by means of a first communications network and being further configured to acquire from each alarm RFID reader, through said first communications network, the alarm information generated by said alarm RFID reader, the first communications network being comprised in the set formed by: a wireless network, a wired network, and a mixed wired and wireless network.

14. The system according to claim 1, wherein the central control and monitoring computer is connected to the monitoring RFID readers by means of a second communications network comprised in the set formed by: a wireless network, a wired network, and a mixed wired and wireless network.

15. The system according to claim 1, wherein the central control and monitoring computer is further configured to:

store all the information acquired;

generate and keep up-to-date a corresponding safety status for each worker, on the basis of all the information acquired; and provide a user with the generated safety statuses by means of a user interface.

16. The system of claim 1, wherein the corresponding first sensor comprises at least one photoelectric, pressure, light, capacity and magnetic sensors to detect that the personal protective equipment is worn by the worker.

* * * * *